US005478209A

United States Patent [19]

McDonough

[11] Patent Number: 5,478,209

[45] Date of Patent: Dec. 26, 1995

[54] JET BARREL AND HOSE FITTING INSERT FOR A JET PUMP

[75] Inventor: Charles M. McDonough, Stamford, Conn.

[73] Assignee: PCF Group, Inc., Stamford, Conn.

[21] Appl. No.: 273,333

[22] Filed: Jul. 11, 1994

[51] Int. Cl.[6] ..... F04F 5/00

[52] U.S. Cl. ..... 417/174; 417/54; 417/181; 417/195

[58] Field of Search ..... 417/54, 151, 174, 417/181, 195, 118

[56] References Cited

U.S. PATENT DOCUMENTS

| | | | |
|---|---|---|---|
| 4,135,861 | 1/1979 | Brown et al. | 417/195 |
| 4,807,814 | 2/1989 | Douche et al. | 417/174 |
| 4,846,617 | 7/1989 | Ehrhardt | 417/151 |

OTHER PUBLICATIONS

Catalog sheet showing Gema brand injector assembly sold from 1972 to 1977.

Catalog sheet showing Gema brand injector assembly sold from 1977 to 1984.

Catalog sheet showing Ransburg Gema brand injector assembly sold from 1984 to 1986.

Catalog sheet showing Gema–Volstatic type 11/12 pump assembly models 106528 and 107160 sold from 1984 to 1986.

Catalog sheet showing Gema–Volstatic type IV30 pump assembly model 101733 sold from 1986 to 1988.

Catalog sheet showing Gema–Volstatic type PI–1 pump assembly model 110316 sold from 1988 to 1991.

Catalog sheet showing Gema–Volstatic type PI–3 pump assembly model 114635 sold from 1991 to date.

*Primary Examiner*—Charles Freay

*Attorney, Agent, or Firm*—Barry R. Lipsitz

[57] ABSTRACT

A jet barrel and hose fitting insert are provided for a jet pump that supplies coating powder to a spray gun. The insert reduces the likelihood of impact fusion in the barrel and fitting. The insert comprises a cylindrical portion of small outside diameter in alignment with a cylindrical portion of large outside diameter with a longitudinal bore through both portions. The insert is retained in a hose fitting which fastens into the jet pump. The upstream end of the insert is positioned to receive the jet flow and to close a supplementary air chamber in the pump.

15 Claims, 1 Drawing Sheet

JET BARREL AND HOSE FITTING INSERT FOR A JET PUMP

BACKGROUND OF THE INVENTION

This invention relates to powder coating apparatus, and more particularly to a fluid jet pump for conveying coating powder.

Objects are commonly coated by spraying an electrically charged powder onto the object which is electrically grounded. Electrostatic attraction holds the powder on the object until heat is applied to flow the powder together and to cure it. An apparatus for electrostatic powder coating is typically comprised of an electrostatic voltage generator, a container for holding and suspending powder in fluid, a fluid jet pump for conveying fluidized powder, and a spray gun. Using additional fluid, the jet pump induces a stream of fluidized powder from the container and propels the fluidized powder through a hose leading to the spray gun. The powder particles are electrically charged in the gun and sprayed onto the object. The fluid commonly used is air, although other fluids may be used.

Within the jet pump, a nozzle receives pressurized injector fluid and discharges the injector fluid at high velocity through an injection chamber and into the bore of a jet barrel. The high velocity fluid jet reduces the pressure in the injection chamber thereby inducing a flow of powder particles suspended in fluid from the powder container. The induced suspended powder is propelled by the jet into and through the barrel bore. Typically, the barrel bore discharges the powder stream into a bore through a fitting over which the end of a hose leading to the gun is fitted and fastened.

To control the amount of coating powder sprayed from the gun onto the object, the pressure of the injector fluid is varied to vary the pressure in the injection chamber and thus the rate of induction of fluidized powder from the powder container into the jet pump. As a result, the rate of fluid injected varies. The amount of coating powder desired for spraying may be so reduced, however, that the reduced rate of flow of injector fluid is insufficient to maintain fluidization of the powder within the hose. Consequently, a flow of supplementary fluid is provided which is commonly introduced at the juncture between the jet barrel and the hose fitting.

In operation over time, the bore in the jet barrel, the bore in the hose fitting and junctures between the barrel and the hose fitting are susceptible to buildup and clogging with fused powder particles. This phenomenon is called impact fusion, and is believed to result from the generation of heat in the contact and impact of high velocity powder particles on surfaces and junctures, causing the particles to adhere and cure.

Materials which are slippery and relatively soft alleviate the problem of buildup and clogging by impact fusion. Such a material is polytetrafluoroethylene, as is sold under the trademark, Teflon. Even in such materials, however, junctures exposed to high velocity suspended powder flows are subject to impact fusion.

Surfaces contacted by the high velocity jet of fluid and suspended powder particles in the pump, namely the jet barrel and hose fitting, are subject to erosion and wear and require periodic replacement. Relatively soft materials such as Teflon are particularly subject to erosion and wear by contact with high velocity jets of fluid and suspended powder particles. Thus, more frequent periodic replacement is necessitated of a jet barrel and hose fitting fabricated of material such as Teflon.

Materials such as Teflon are not capable of mass production by injection molding. Useful geometric shapes in such materials must be produced by machining. Machining of a complex object as an integral jet barrel and hose fitting from Teflon is undesirably expensive. Periodic replacement of such a costly object is economically undesirable. Still further, a hose fitting fabricated of slippery material such as Teflon allows a hose to slip off readily. High clamping forces on the hose end to secure retention subject a Teflon fitting of acceptable wall thickness to deformation and collapse.

What is needed is an economical apparatus and method in a jet pump to receive and conduct a high velocity fluid flow of suspended powder from the discharge of a nozzle to the entrance of a hose without clogging by impact fusion. The apparatus desirably should be without juncture in the surfaces contacted by the high velocity flow of suspended powder, capable of convenient periodic replacement in the jet pump, and of simple geometry amenable to inexpensive machining from soft and slippery materials such as Teflon.

SUMMARY OF THE INVENTION

The present invention satisfies the above needs. An apparatus embodiment of the invention provides a novel jet barrel and hose fitting insert without juncture for a fluid jet pump for supplying coating powder to a spray gun. The insert comprises a downstream cylindrical portion having a downstream end and a small outside diameter. This downstream portion is for containment within a small longitudinal bore in a hose fitting in the jet pump. The insert further comprises an upstream cylindrical portion of large outside diameter in axial alignment with the downstream cylindrical portion of small outside diameter. A downstream section of length of the upstream portion is for containment in a large longitudinal bore in the hose fitting. An upstream section of length of the upstream portion is for extending through a supplementary fluid chamber within the jet pump, and has an upstream end for closing an opening to the supplementary fluid chamber at the upstream extremity of the chamber. The upstream and downstream portions of the insert have a longitudinal bore extending from the upstream end of the upstream portion to the downstream end of the downstream portion. The bore is for accepting and discharging a jet of injected fluid.

The upstream section of length for extending through the supplementary fluid chamber preferably has at least one hole leading from the outside surface of the insert to the bore extending through the insert, the hole being provided for the passage of supplementary fluid. Preferably the insert is fabricated from a single piece of material. Preferred materials for the insert are polytetrafluoroethylene, acetyl resin, and ultra high molecular weight polyethylene. The insert can alternatively be constructed as a hollow cylindrical component having a constant outside diameter, one end of which is adapted to be press-fit into the bore of the hose fitting with the other end thereof extending into and closing the supplementary fluid chamber of the jet pump.

Another aspect of the invention is a jet pump including the insert described above. Yet another aspect of the invention is a method for reducing the likelihood of clogging by impact fusion in a jet pump. The method comprises providing an insert of the nature described above, inserting the insert into the hose fitting of a jet pump, inserting the hose fitting containing the insert into the jet pump, and securing the hose fitting into the jet pump.

BRIEF DESCRIPTION OF THE DRAWING

These and other features, aspects, and advantages of the present invention will become better understood with regard to the following description, appended claims, and accompanying drawings.

DETAILED DESCRIPTION OF THE INVENTION

Figure 1:
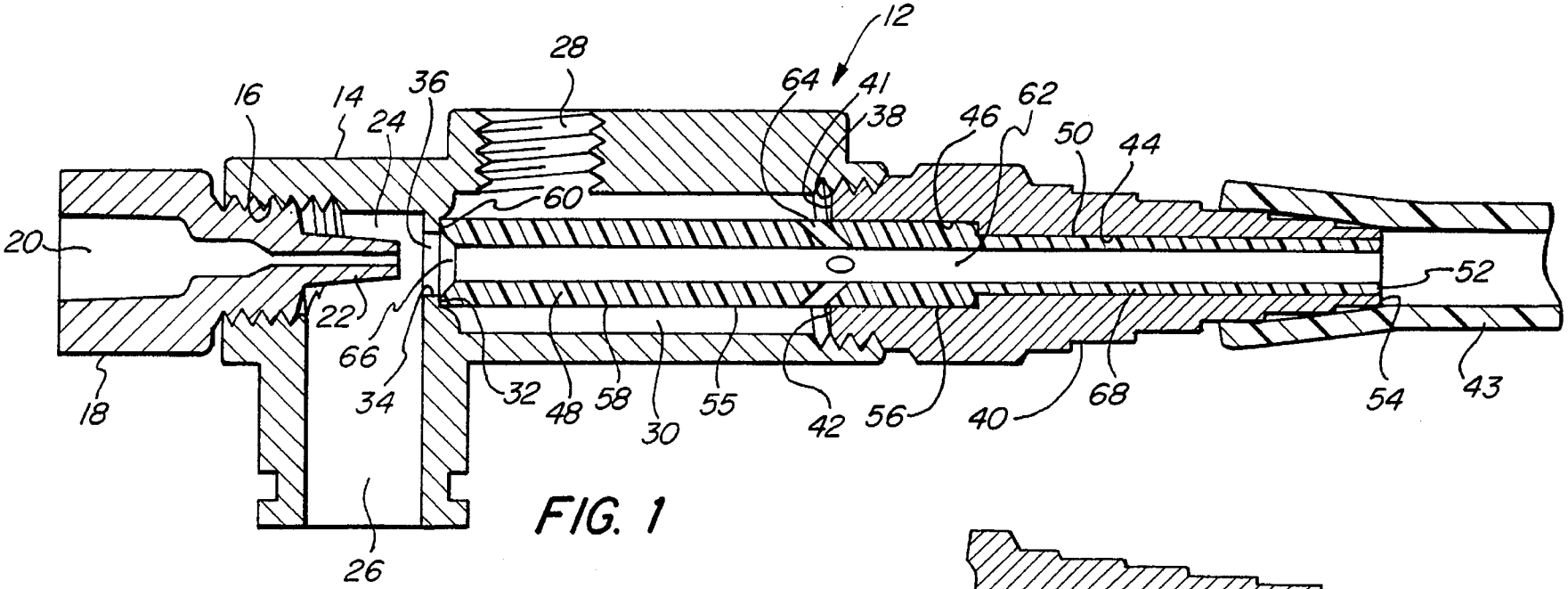
FIG. 1 is a sectional view of a jet pump embodying the present invention.

Referring to the drawing, a jet pump 12 embodying the present invention includes a housing 14 having an opening 16 for retaining a fluid injector fitting 18 which has a port 20 for the supply of pressurized fluid and a fluid injector discharge nozzle 22. The nozzle protrudes into a first bore in the housing which forms an injection chamber 24 wherein reduced pressure is produced. Opening into the injection chamber 24 is an induction port 26 for receiving a conduit for the supply of a stream of coating powder suspended in fluid induced by the reduced pressure in the injection chamber. For receiving a supply of supplementary fluid, the housing also has a supplementary port 28 which opens into a second bore axially in line with the first bore thereby forming a supplementary fluid chamber 30. Between the downstream extremity of the injection chamber 24 and the upstream extremity 32 of the supplementary fluid chamber 30 exists a wall 34. A third bore of smaller diameter than the second bore passes through the wall 34 providing an opening 36 between the injection chamber 24 and the supplementary fluid chamber 30.

The downstream end 38 of the supplementary fluid chamber 30 has a female thread wherein a hose fitting 40 with a male thread is screwed. The upstream end 41 of the hose fitting thereby forms the downstream extremity 42 of the supplementary fluid chamber 30. The exterior of the hose fitting extending downstream of the pump housing has several sections of length of progressively smaller outer diameter to accommodate installation of the end of a hose 43 over the hose fitting. To secure the hose onto the fitting, a circumferential hose clamp (not shown) which acts to reduce and compress the circumference, and thus the diameter of the hose, may be installed.

The hose fitting material may be metal, such as aluminum, or plastic which may be formed in mass production such as by injection molding. Metal is preferred, being less slippery than plastic, and stronger than plastic so that a clamp can be more tightly installed without risk of deformation of the fitting.

Passing through a downstream portion of the hose fitting 40 is a longitudinal bore 44 of small diameter which opens into an axially aligned bore 46 of large diameter passing through an upstream portion of the fitting. The bores in the hose fitting serve to retain an insert 48 which functions as both an internal liner for the hose fitting and as a jet barrel for receiving and conducting the fluid jet from the injection chamber.

The insert 48 has a downstream cylindrical portion 50 with a small outer diameter for containment within the small longitudinal bore 44 in the hose fitting. The downstream end 52 of the downstream cylindrical portion of the insert preferably coincides approximately with the downstream end 54 of the hose fitting.

The insert 48 also has an upstream cylindrical portion 55 of large outer diameter in longitudinal axial alignment with its downstream portion 50. This upstream portion 55 has a downstream section of length 56 for containment within the large bore 46 in the hose fitting. The upstream portion 55 also has an upstream section of length 58 for extending through the supplementary fluid chamber 30 within the jet pump, and an upstream end 60 for closely approaching and preferably contacting the upstream extremity 32 of the supplementary fluid chamber 30. Thus, the upstream end 60 of the insert serves to close the opening 36 into the upstream extremity 32 of the supplementary fluid chamber 30. In effect, the insert 48 is confined between the upstream extremity 32 of the supplementary fluid chamber 30 and the upstream end 41 of the hose fitting.

Passing longitudinally through the insert is a longitudinal bore 62 extending from the upstream end 60 of the upstream portion to the downstream end 52 of the downstream portion. The bore 62 is for receiving and discharging a jet of fluid emanating from the injector nozzle 22. Within the upstream section of insert length 58 extending through the supplementary fluid chamber 30 is at least one hole 64 for passing supplementary fluid from the outside surface of the insert into the longitudinal bore 62 extending through the insert.

Figure 2:
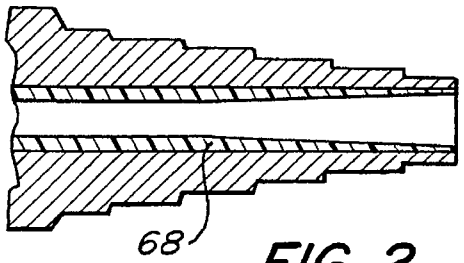
FIG. 2 is a partial sectional view of the longitudinal bore with an expanding cross-section.

The longitudinal bore 62 through the insert at the upstream end 60 of the insert may have a flared entrance 66 with the wide portion of the flare facing upstream for accepting a jet of injected fluid. The longitudinal bore 62 through the insert may be of constant diameter. Optionally the longitudinal bore may have a section 68 of expanded or expanding cross section in the downstream direction a shown in FIG. 2.

Preferably, the insert is formed out of a single piece of material to avoid junctures where impact fusion can occur. Also, the insert is preferably fabricated of a slippery and relatively soft material not susceptible to clogging by impact fusion. Such materials may comprise synthetic fluorine-containing resin, for example, polytetrafluoroethylene, as is sold under the trademark Teflon; acetal resin, as is sold under the trademark Delrin; and ultra high molecular weight polyethylene, as is sold under the trademark Tyvar. These materials, however, are not susceptible to inexpensive mass production by injection molding, and require machining to form useful shapes.

The present invention provides an advantageous insert of simple geometry lending itself to facile, inexpensive fabrication by machining. Thus the insert may be economically produced from soft, slippery materials not amenable to injection molding. The use of such materials for the insert reduces the likelihood of clogging by impact fusion. The geometry of the insert avoids any juncture where impact fusion may tend to occur. The geometry of the insert also allows the use of a configuration for the jet pump housing which in itself is simple and relatively inexpensive to manufacture. The insert provided by the invention is easy and quick to install in the jet pump.

The invention also provides a method for reducing the likelihood of clogging by impact fusion in a jet pump. The method comprises providing an insert of the nature described above, inserting the insert into the hose fitting of a jet pump, inserting the hose fitting containing the insert into the jet pump, and securing the hose fitting into the jet pump. Thus this invention satisfies long felt needs.

Although the present invention has been described with reference to certain preferred versions, other versions are possible. For example, an insert with a constant outer diameter over its entire length could be used. One end of this insert would be press-fit into the hose fitting, with the other end thereof extending into the supplementary fluid chamber. Therefore, the spirit and scope of the appended claims should not be limited to the description of the preferred versions contained herein.

What is claimed:

1. A jet barrel and hose fitting insert for a jet pump for supply of coating powder to a spray gun, said insert comprising:

(a) a downstream cylindrical portion having a downstream end and a small outside diameter, said downstream portion for containment within a small longitudinal bore in a hose fitting in the jet pump;

(b) an upstream cylindrical portion of large outside diameter in axial alignment with said downstream cylindrical portion, said upstream portion having:

(1) a downstream section of length for containment within a large longitudinal bore in the hose fitting;

(2) an upstream section of length for extending through a supplementary fluid chamber within the jet pump; and (3) an upstream end for sealing an opening to the supplementary fluid chamber at its upstream extremity; and (c) wherein said downstream and upstream cylindrical portions have a longitudinal bore extending from said upstream end of said upstream portion to said downstream end of said downstream portion, said bore for accepting and discharging a jet of injected fluid.

2. The insert as in claim 1 wherein said bore in said upstream and downstream portions at said upstream end of said upstream portion has a flared entrance with a wide portion of the flare facing upstream for accepting a jet of injected fluid.

3. The insert as in claim 1 wherein said bore in said upstream and downstream portions is of constant diameter.

4. The insert as in claim 1 wherein said bore in said upstream and downstream portions has a length of cross section expanding in the downstream direction.

5. The insert as in claim 1 wherein said upstream section of length for extending through the supplementary fluid chamber has at least one hole leading from the outside surface of the insert to said bore extending through the insert, said hole for the passage of supplementary fluid.

6. The insert as in claim 1 wherein said insert is fabricated from a material selected from the group consisting of fluorine containing resin, acetal resin, and ultra high molecular weight polyethylene.

7. The insert as in claim 1 wherein said insert is fabricated from a single piece of material.

8. The insert as in claim 1 wherein said downstream cylindrical portion has length for extending downstream approximately as far as the hose fitting extends downstream.

9. A method for reducing the likelihood of clogging by impact fusion in a jet pump for supplying coating powder to a spray gun, said method comprising:

(a) providing an insert comprising (1) a downstream cylindrical portion having a downstream end and a small outside diameter, said downstream portion for containment within a small longitudinal bore in a hose fitting in the jet pump;

(2) an upstream cylindrical portion of large outside diameter in axial alignment with said downstream cylindrical portion, said upstream portion having:

(i) a downstream section of length for containment within a large longitudinal bore in the hose fitting;

(ii) an upstream section of length for extending through a supplementary fluid chamber within the jet pump; and (iii) an upstream end for sealing an opening to the supplementary fluid chamber at its upstream extremity; and (3) wherein said downstream and upstream cylindrical portions have a longitudinal bore extending from said upstream end of said upstream portion to said downstream end of said downstream portion, said bore for accepting and discharging a jet of injected fluid;

(b) inserting said insert into the hose fitting;

(c) inserting said hose fitting containing said insert into the jet pump; and (d) securing said hose fitting into the jet pump.

10. A jet pump for supplying coating powder to a spray gun with reduced likelihood of clogging of the jet pump by impact fusion of powder, said jet pump including a jet barrel and hose fitting insert comprising:

(a) a downstream cylindrical portion having a downstream end and a small outside diameter, said downstream portion for containment within a small longitudinal bore in a hose fitting in the jet pump;

(b) an upstream cylindrical portion of large outside diameter in axial alignment with said downstream cylindrical portion, said upstream portion having:

(1) a downstream section of length for containment within a large longitudinal bore in the hose fitting;

(2) an upstream section of length for extending through a supplementary fluid chamber within the jet pump; and (3) an upstream end for sealing an opening to the supplementary fluid chamber at its upstream extremity; and (c) wherein said downstream and upstream cylindrical portions have a longitudinal bore extending from said upstream end of said upstream portion to said downstream end of said downstream portion, said bore for accepting and discharging a jet of injected fluid.

11. A jet barrel and hose fitting insert for a jet pump for supply of coating powder to a spray gun, said insert comprising:

a cylinder fabricated from an impact fusion resistant material having a first end for containment within a bore of a hose fitting in the jet pump and a second end for extending through a supplementary fluid chamber within the jet pump, said second end adapted to seal an upstream opening to the supplementary fluid chamber; and a longitudinal bore extending through said cylinder from said second end to said first end for accepting and discharging a jet of injected fluid;

wherein said insert is of a length substantially equal to the distance between said upstream opening to the supplementary fluid chamber and a fluid exit of said hose fitting, for providing a continuous and unimpeded path for said jet of injected fluid from said upstream opening to said fluid exit.

12. The insert as in claim 11 comprising at least one supplementary fluid opening leading from the outside surface of the insert to said longitudinal bore, for the passage of supplementary fluid from said supplementary fluid chamber.

13. The insert as in claim 11 wherein said insert is fabricated from a material selected from the group consisting of fluorine containing resin, acetal resin, and ultra high molecular weight polyethylene.

14. The insert as in claim 11 wherein said insert is fabricated from a single piece of material.

15. The insert as in claim 11 wherein said first end is adapted to be press fit into the bore of said hose fitting.

* * * * *